US006561374B2

(12) United States Patent
Longstreth

(10) Patent No.: US 6,561,374 B2
(45) **Date of Patent: *May 13, 2003**

(54) SALAD BOWL WITH A LID

(75) Inventor: James R. Longstreth, Whittier, CA (US)

(73) Assignee: Pactiv Corporation, Lake Forest, IL (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/758,756

(22) Filed: Jan. 11, 2001

(65) Prior Publication Data

US 2001/0007326 A1 Jul. 12, 2001

Related U.S. Application Data

(63) Continuation of application No. 09/453,335, filed on Dec. 2, 1999, which is a division of application No. 08/788,513, filed on Jan. 24, 1997, now Pat. No. 6,073,795, which is a continuation of application No. 29/052,647, filed on Apr. 4, 1996, now Pat. No. Des. 381,563.

(51) Int. Cl.[7] ..... B65D 8/04

(52) U.S. Cl. ..... 220/574; 220/669; 220/631; 220/756; 220/DIG. 13

(58) Field of Search ..... 220/631, 574, 220/669, 756, DIG. 13, 576

(56) References Cited

U.S. PATENT DOCUMENTS

| | | | | |
|---|---|---|---|---|
| 528,072 | A | | 10/1894 | Weiss et al. |
| 933,881 | A | | 9/1909 | Brown |
| 1,394,540 | A | * | 10/1921 | Diack ..... 220/631 |
| 1,507,685 | A | | 9/1924 | Robinson |
| 1,696,098 | A | | 12/1928 | McGranighan |
| 1,974,898 | A | | 9/1934 | Rutledge |
| 2,031,800 | A | * | 2/1936 | Thiele ..... 220/631 |
| 2,170,040 | A | | 8/1939 | Stuart |
| 2,179,188 | A | | 11/1939 | Kitselman |
| D131,150 | S | | 1/1942 | Swofford |
| 2,283,704 | A | | 5/1942 | Staudal |
| 2,811,152 | A | | 10/1957 | Wicks |
| 3,037,677 | A | | 6/1962 | Debs |
| D194,434 | S | | 1/1963 | Whitman et al. |
| 3,176,879 | A | * | 4/1965 | Mojonnier ..... 220/771 |
| 3,474,929 | A | | 10/1969 | Harker |
| 3,598,278 | A | | 8/1971 | Vann |
| 3,625,305 | A | | 12/1971 | Mueller et al. |
| 3,737,068 | A | | 6/1973 | Bird |
| 4,055,273 | A | * | 10/1977 | Jones ..... 220/631 |
| 4,157,762 | A | | 6/1979 | Robinson |
| 4,197,940 | A | | 4/1980 | DeRossett |
| 4,202,464 | A | | 5/1980 | Mohs et al. |
| 4,705,163 | A | | 11/1987 | James |
| 4,874,083 | A | | 10/1989 | Antoni et al. |
| 4,901,858 | A | | 2/1990 | Anderson |
| 4,909,392 | A | | 3/1990 | Williams et al. |
| 4,928,860 | A | * | 5/1990 | Knight ..... 220/631 |
| 4,930,627 | A | | 6/1990 | Borst et al. |
| 4,961,494 | A | | 10/1990 | Alexander |
| 4,962,849 | A | | 10/1990 | Anderson |
| 5,011,006 | A | | 4/1991 | Anderson |
| 5,096,083 | A | * | 3/1992 | Shaw et al. ..... 220/771 |
| 5,169,023 | A | * | 12/1992 | Heiberg et al. ..... 220/631 |
| 5,375,701 | A | | 12/1994 | Hustad et al. |
| 5,390,816 | A | | 2/1995 | Boyd |
| 5,542,565 | A | | 8/1996 | Hidalgo-Lopez |
| D381,563 | S | | 7/1997 | Longstreth |
| 5,657,873 | A | | 8/1997 | Hustad et al. |
| 5,657,874 | A | | 8/1997 | Hustad et al. |
| 5,695,798 | A | | 12/1997 | Rozzano |
| D392,159 | S | | 3/1998 | Longstreth |

FOREIGN PATENT DOCUMENTS

| | | |
|---|---|---|
| WO | WO 98/32665 | 7/1998 |

* cited by examiner

*Primary Examiner*—Joseph M. Moy
(74) *Attorney, Agent, or Firm*—Jenkens & Gilchrist

(57) ABSTRACT

A salad bowl made of a plastic moldable material having a platform adjacent one side of the bowl to permit the bowl to rest on the platform so that the bowl may be maintained in an upright position. In the preferred embodiment of the invention, a cover is capable of fitting over the top of the bowl for maintaining the contents of the bowl in place when the bowl is positioned in its upright position.

12 Claims, 5 Drawing Sheets

SALAD BOWL WITH A LID

RELATED APPLICATIONS

This is a continuation of U.S. patent application Ser. No. 09/453,335 filed on Dec. 2, 1999, which is a divisional of U.S. patent application Ser. No. 08/788,513, filed Jan. 24, 1997, now issued as U.S. Pat. No. 6,073,795, which is a continuation of U.S. Patent Application No. 29/052,647, filed Apr. 4, 1996 now issued as U.S. Pat. No. D381,563, which are incorporated by reference.

BACKGROUND OF THE INVENTION

1. Field of the Invention

The present invention relates to a food container such as a salad bowl, and in particular to a container that may be stored on a store shelf in an upright manner so as to readily display the container contents to a store customer.

2. Description of the Related Art

There have been a number of salad bowls made of plastic moldable materials, such as PVC or PET, which are used for holding food products. The bowls typically have a cylindrical configuration with a generally circular cover that fits over the top of the bowl for maintaining the contents of the bowl from falling out. The cover can be either a "snap on cover", one that can be reused if desired, or a sealed cover, one that is adhered to the top edge of the bowl by suitable means, such as adhesive or heat, and which cannot be reused.

For the purposes of display in stores, if the bowls are placed on the shelves of the store in their conventional manner, i.e., one on top of the other, then the contents of the bowls are not readily observable by someone walking down the aisles of the store. It is well known by those in the grocery trade that the more visible the product, the more likely it is that the consumer will buy the product. It would be advantageous therefore, to have a bowl that may be stackable one upon the other for purposes of shipment or storage while capable of being displayed in a stable upright position when placed on store shelves for sale.

SUMMARY OF THE INVENTION

In accordance with the present invention a conventional bowl or container may be stored on its side in an upright position so that the contents of the bowl will be facing the customer as the customer walks down the aisle of the store. This is achieved by having a foot or platform portion of the molded bowl arranged so as to provide stable footing for the bowl placed in the upright position. More specifically, the foot consists of a segment of the bowl that extends from the side wall of the bowl in a rearward and downward direction, terminating in a flat surface portion that is substantially in alignment with the top surface of the bowl. The top surface or peripheral edge of the bowl therefore forms one point of contact with the store shelf, and the flat surface of the foot forms a second point of contact with the store shelf, maintaining the bowl in an upright orientation.

In the preferred embodiment of the invention, a removable cover is interlockably attached to the bowl and may be repeatedly attached and removed from the bowl. The cover removably attaches to the top edge of the bowl in any number of well known manners.

OBJECTS OF THE INVENTION

It is an object of the present invention to provide a bowl that can be set on its side and maintained in an upright orientation;

It is a further object of the invention to provides a bowl that can be easily made in one piece of plastic material.

These and other objects of the invention will be apparent from a review of the accompanying specification and drawings.

DETAILED DESCRIPTION OF THE INVENTION

Figure 1:
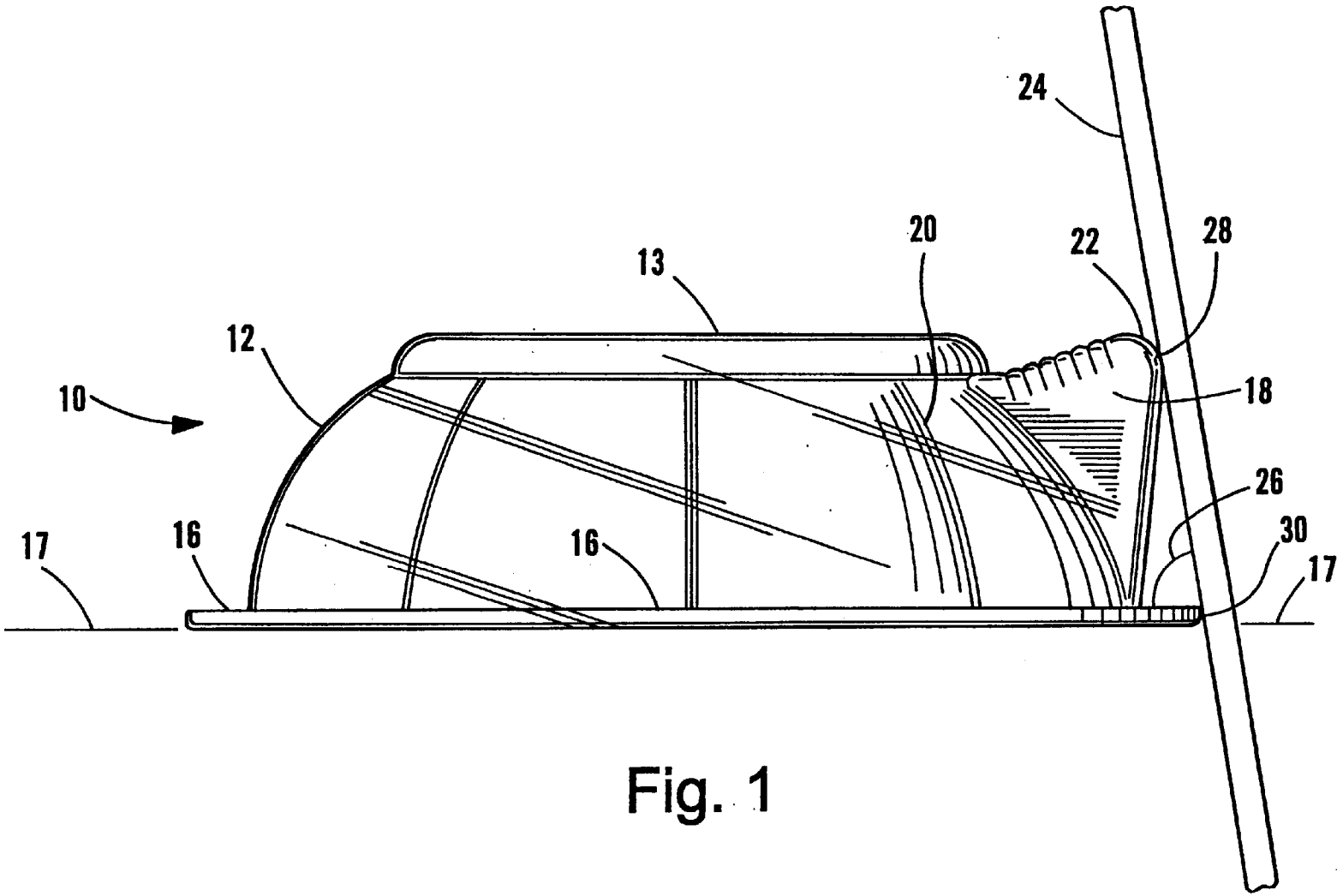
FIG. 1 is a perspective view of the bowl of the present invention resting, in the upright position, on a horizontal surface.
Figure 2:
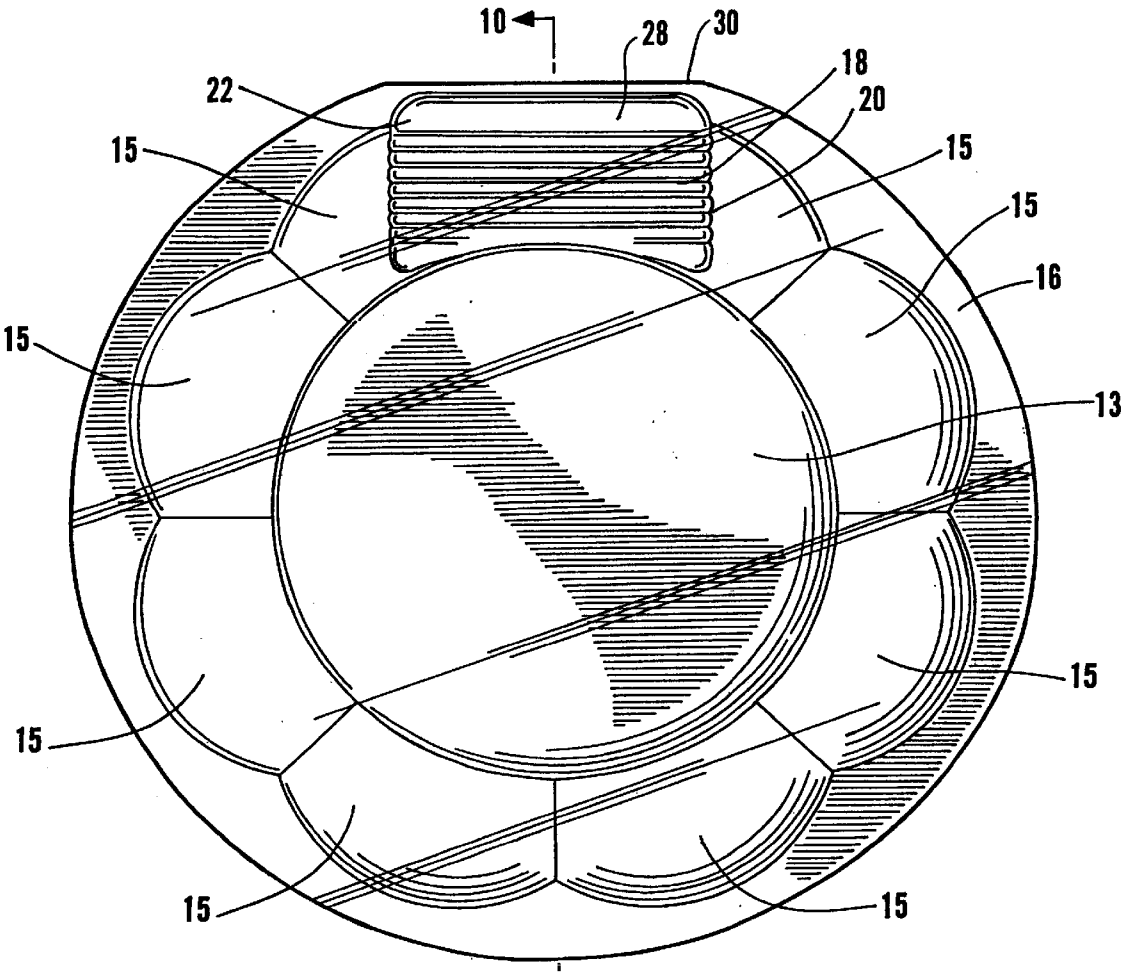
FIG. 2 is a bottom view of the bowl of the present invention.
Figure 3:
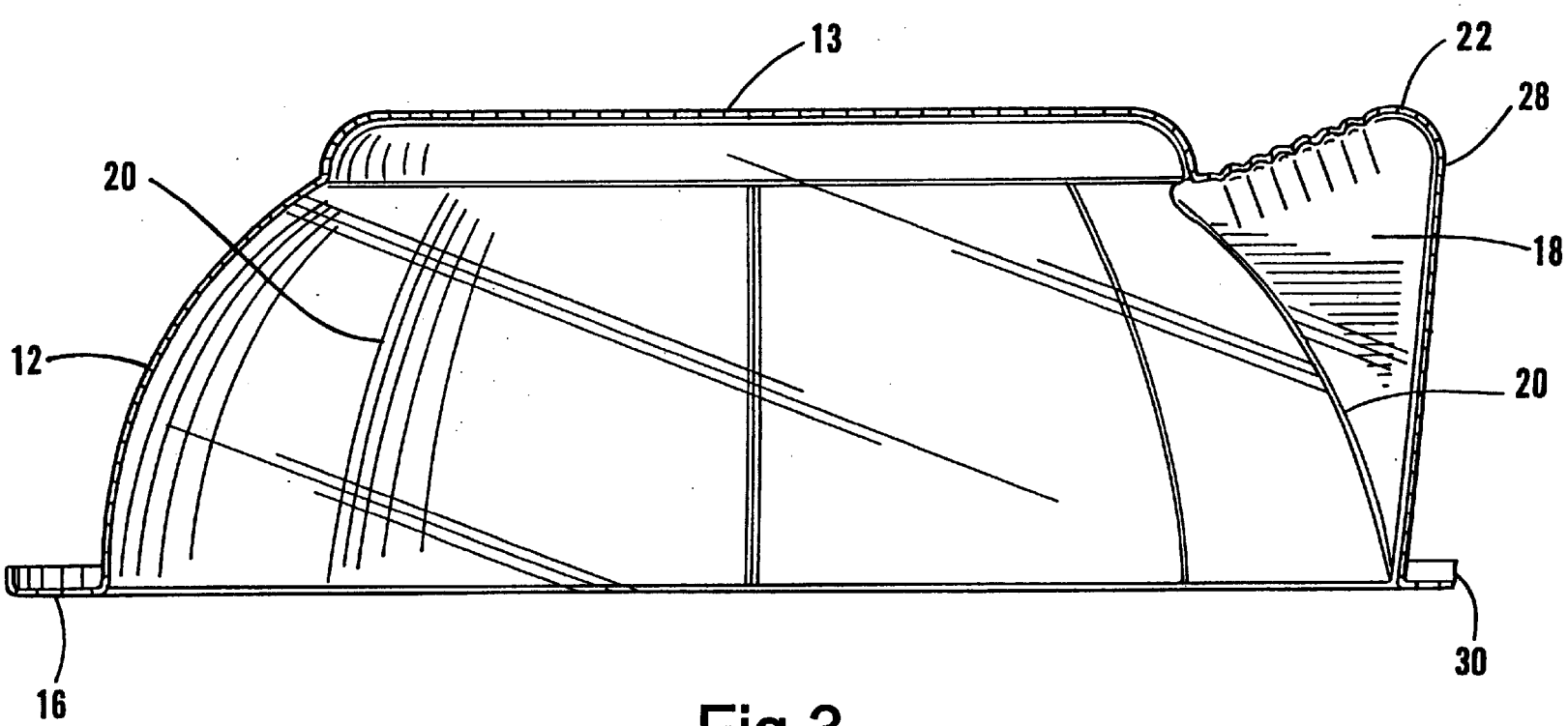
FIG. 3 is a cross-sectional view taken along line 10—10 of FIG. 2.

Referring now to the drawings and in particular to FIGS. 1, 2 and 3, the two piece food container is shown and generally referenced by the numeral 10. Container 10, which may be constructed of any one of a number of clear resilient plastic materials known in the art, consists of a bowl portion 12 having a flat planar base 13, sidewalls 20 and an upper peripheral edge 16. A cover or lid portion 14 (shown in FIGS. 4 and 5) which, as will be described in further detail below, is sized and shaped to fit over upper peripheral edge 16 of the bowl portion 12 and serves, by means of an interference or press fit, to provide the bowl portion 12 with a tight seal. The flat planar base 13 is parallel to upper peripheral edge 16. Upper peripheral edge 16 is essentially circular and lies in a plane 17. When the base 13 is placed upon a horizontal surface, the container 10 rests in a horizontal position.

The interior shape of the bowl portion 12 is generally annular with decreasing annular diameters progressing from the peripheral edge 16 to the base 13. Scalloped portions 15 are phased sequentially around the bowl portion 12 to provide an overall decorative and aesthetic appeal to the container 10, as well as to provide structural rigidity. Although shown in generally annular cross-section (see FIGS. 2 and 3) it is to be understood that other shapes such as oval, scalloped, square or rectangular, are also within the contemplation of the present invention.

A platform (or foot) 18 projects outwardly and downwardly from sidewall 20 and serves to stabilize and maintain the container 10 in an upright position (as shown in FIG. 1) when both the platform 18 and upper peripheral edge 16 are placed in contact with a horizontal surface such as a store shelf. The end 22 of the platform 18 is positioned, in the preferred embodiment, so that a straight line drawn from platform end 22 to upper peripheral edge 16 (representing a horizontal surface 24 upon which the container 10 rests) forms an included angle 26 that is preferably less than 90 degrees with respect to the plane 17. Accordingly when placed on a store shelf in the upright position, the container 10 tilts slightly backwards to provide better visibility of its contents when observed by passers-by and prevent forward tipping. Preferably, the end 22 extends outward and downward to the extent such that, when the container 10 rests on a horizontal surface, on its side, angle 26 is in the range of about 70 to 80 degrees. A flat surface 28 extends the width of the platform 18 along its end 22. Peripheral edge 16 includes a flat outer surface 30 that is sized and positioned to be parallel and in registration with flat surface 28. Outer surface 30 and flat surface 28 provide two extended points of contact along a horizontal surface so as to further maintain the container 10 stable in the upright position.

Figure 4:
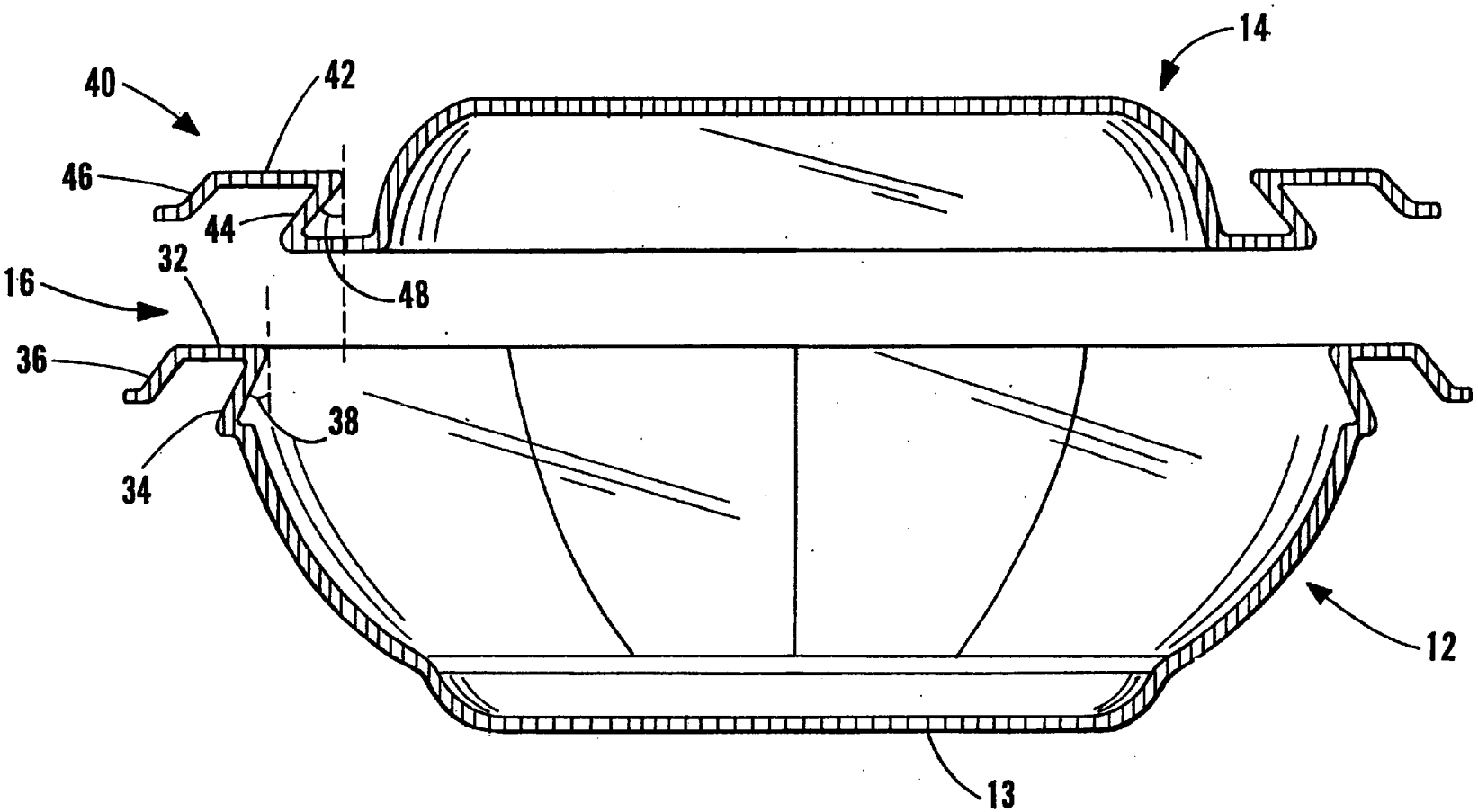
FIG. 4 is a partial cut away view of the bowl and the cover showing an interlocking arrangement between the cover and bowl of the present invention.
Figure 5:
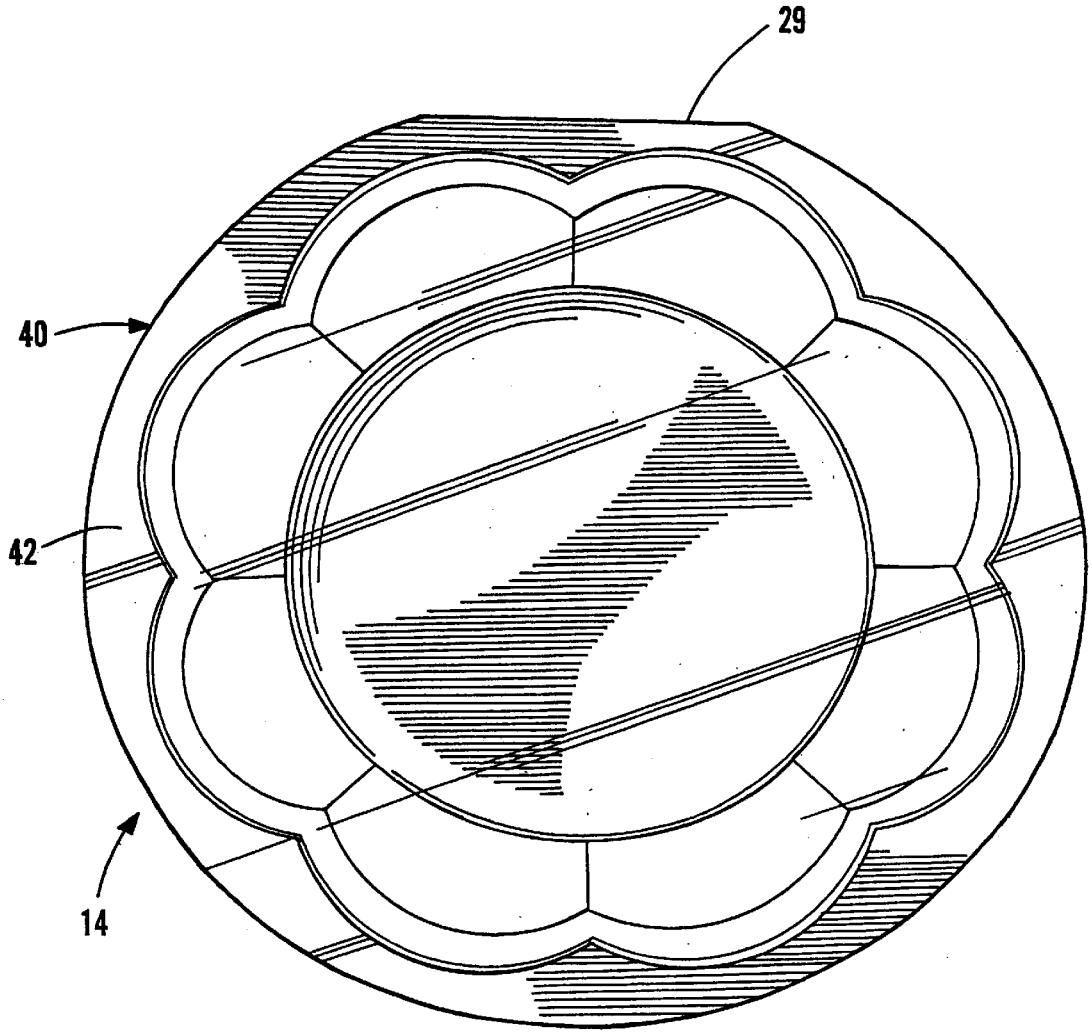
FIG. 5 is a bottom view of the lid of the bowl of the present invention.

Lid 14 shown in FIG. 4 is closeable over bowl portion 12 and is sized and shaped to fit snugly over the peripheral edge 16 so that when urged onto the peripheral 16 a press fit is maintained thereby providing a tight seal of the bowl portion 12. Lid 14 includes an edge surface 29 (FIG. 5), dimensioned and positioned to be parallel to and in registration with, bowl portion outer surface 30 when the lid 14 is closed on the bowl portion 12.

As shown in the partial cross-section of FIG. 4 peripheral edge 16 includes raised surface 32 from which depend walls 34 and 36. Wall 34 flairs away from surface 32 at acute angle 38. Similarly lid 14, includes a peripheral edge 40 that includes raised surface 42 from which depend walls 44 and 46. Wall 44 flairs away from surface 42 at acute angle 48 that is slightly greater than angle 38. In this fashion, when peripheral edge 40 is urged against peripheral edge 16 wall 44 will interfere with walls 34 to achieve a press fit therebetween. Although one embodiment has been disclosed, it is recognized that one skilled in the art may utilize alternate interlocking arrangements. For example, an adhesive may be applied to one or the other of peripheral edges 16 or 40, so that the lid portion 14 may be adhesively secured to the bowl portion 12 and access to the contents of the container 10 is achieved by pulling away the lid portion 14 from the bowl portion 12.

Although the invention has been described relative to a specific embodiment thereof, there are numerous variations and modifications that will be readily apparent to those skilled in the art in the light of the above teachings. For example, a number of various interlocking arrangements can be used to achieve securing the cover to the bowl either for repeatable use or for one time use. Further, in the upright position the container may be vertical, that is orthogonal to the surface upon which the container rests. It is therefore to be understood that, within the scope of the appended claims, the invention may be practiced other than as specifically described.

What is claimed is:

1. A food container for storing and displaying food items contained therein comprising:

a molded bowl for storing the food items including an interior surface, an opening, a base, a bowl sidewall, and a foot, said foot formed by at least two separate integrally molded foot sidewalls extending from said bowl sidewall, and wherein said foot further includes an interior coextensive with the interior surface of the bowl; and a lid, said lid being interlockable with said bowl;

wherein said foot is capable of supporting said bowl without the assistance of said base such that said bowl can be used in two separate display positions.

2. The food container of claim 1, wherein said lid is separate from said bowl.

3. The food container of claim 1, wherein said bowl, said lid, or both are composed of a transparent material.

4. The food container of claim 1, wherein said container further comprises a peripheral edge which supports said container when said container is placed in an upright position using said integral foot.

5. The food container of claim 4, wherein the cross sectional area of said container is greater near said peripheral edge than near the base of said container.

6. The food container of claim 4, wherein said peripheral edge and said integral foot are arranged such that, when said peripheral edge and said integral foot contact a horizontal surface, the plane of said peripheral edge forms an angle with said horizontal surface of about 90° or less.

7. The food container of claim 6, wherein said angle is between about 70° to about 80°.

8. The food container of claim 4, wherein said peripheral edge and said integral foot each comprise a flat outer surface which contact a surface when said container is positioned upright.

9. The food container of claim 1, wherein said bowl is maintained at an angle of about 90° or less when said foot is in contact with a horizontal surface.

10. The food container of claim 9, wherein said angle is about 70° to about 80°.

11. The food container of claim 1, wherein said food container comprises only one foot.

12. The food container of claim 11, wherein said foot sidewalls are connected to an extend from the interior side of said bowl sidewall.

* * * * *